US010872526B2

(12) United States Patent
Adireddy et al.

(10) Patent No.: US 10,872,526 B2
(45) Date of Patent: Dec. 22, 2020

(54) ADAPTIVE TRAFFIC CONTROL SYSTEM AND METHOD FOR OPERATING SAME

(71) Applicant: Continental Automotive Systems, Inc., Auburn Hills, MI (US)

(72) Inventors: Ganesh Adireddy, Bloomfield Hills, MI (US); Javier Alcazar, Royal Oak, MI (US); Dominik Froehlich, Royal Oak, MI (US); Ibro Muharemovic, Warren, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 74 days.

(21) Appl. No.: 16/127,833

(22) Filed: Sep. 11, 2018

(65) Prior Publication Data

US 2019/0088120 A1 Mar. 21, 2019

Related U.S. Application Data

(60) Provisional application No. 62/560,269, filed on Sep. 19, 2017.

(51) Int. Cl.

| | |
|---|---|
| ***G08G 1/00*** | (2006.01) |
| ***G08G 1/081*** | (2006.01) |
| ***G08G 1/095*** | (2006.01) |
| ***G08G 1/01*** | (2006.01) |
| ***G08G 1/08*** | (2006.01) |
| ***G08G 1/087*** | (2006.01) |
| ***G08G 1/083*** | (2006.01) |

(52) U.S. Cl.

CPC ..... *G08G 1/081* (2013.01); *G08G 1/0145* (2013.01); *G08G 1/08* (2013.01); *G08G 1/083* (2013.01); *G08G 1/087* (2013.01); *G08G 1/095* (2013.01)

(58) Field of Classification Search

CPC ..... G08G 1/081; G08G 1/0145; G08G 1/08; G08G 1/083; G08G 1/87; G08G 1/095

USPC ..... 340/911

See application file for complete search history.

(56) References Cited

U.S. PATENT DOCUMENTS 5,357,436 A * 10/1994 Chiu ..... G08G 1/07 340/916

5,646,853 A * 7/1997 Takahashi ..... G08G 1/08 340/911

(Continued)

FOREIGN PATENT DOCUMENTS

WO 2016143821 A1 9/2016

OTHER PUBLICATIONS https://miovision.com/blog/connected-traffic-signals-care, Connected traffic Signals: do you care? You Should. May 17, 2016/ Traffice Insights/By Dave Bullock.

(Continued)

*Primary Examiner* — Ojiako K Nwugo

(57) ABSTRACT

A method of controlling traffic at a first intersection having a first traffic light is disclosed, including monitoring traffic at the first intersection and storing traffic information from the monitoring in memory; receiving traffic information relating to one or more other intersections in an area in which the first intersection is located; determining a timing sequence for the first traffic light based at least in part upon the traffic information from the monitoring and the received traffic information; and updating control of the first traffic light to utilize the determined timing sequence.

16 Claims, 6 Drawing Sheets

(56) References Cited

U.S. PATENT DOCUMENTS 5,668,717 A * 9/1997 Spall ..... G08G 1/081 700/51
6,339,383 B1 * 1/2002 Kobayashi ..... G08G 1/08 340/907
6,587,778 B2 * 7/2003 Stallard ..... G08G 1/01 340/901
2002/0008637 A1 * 1/2002 Lemelson ..... G08G 1/07 340/907
2002/0116118 A1 * 8/2002 Stallard ..... G08G 1/01 701/117
2002/0186147 A1 * 12/2002 Basinger ..... G08G 1/081 340/910
2007/0008173 A1 * 1/2007 Schwartz ..... G08G 1/081 340/902
2008/0238720 A1 * 10/2008 Lee ..... G08G 1/081 340/909
2009/0076698 A1 * 3/2009 Yokoyama ..... B60T 7/22 701/70
2011/0043378 A1 * 2/2011 Bailey ..... G08G 1/07 340/917
2011/0191011 A1 8/2011 McBride et al.
2012/0038491 A1 2/2012 Publicover
2012/0326890 A1 * 12/2012 Cross ..... G08G 1/082 340/906
2013/0013180 A1 1/2013 Lection et al.
2013/0106620 A1 * 5/2013 Cao ..... G08G 1/082 340/911
2013/0135117 A1 * 5/2013 Morimoto ..... G08G 1/096716 340/905
2014/0335897 A1 11/2014 Clem et al.
2014/0375475 A1 * 12/2014 Wongpiromsarn .... G08G 1/083 340/907
2015/0066350 A1 * 3/2015 Iwata ..... G01C 21/3469 701/400
2015/0102945 A1 * 4/2015 El-Tantawy ..... G08G 1/083 340/909
2015/0371538 A1 * 12/2015 Eichhorst ..... G08G 1/087 340/906
2016/0027299 A1 * 1/2016 Raamot ..... G08G 1/08 340/917
2017/0345297 A1 11/2017 Umehara et al.
2019/0251838 A1 * 8/2019 Bernhardt ..... G01C 21/3415

OTHER PUBLICATIONS http://en.wikipedia.org/wiki/Traffic_light_control_and_coordination, Dec. 19, 2018.
Qiang Lu et al, Autonomous and Connected Intersection Crossing traffic Management using Discrete-Time OccupanciesTrajectory, IEEE'-2017, a. Talks about managing traffic at one intersection.
International Search Report and Written Opinion dated Sep. 16, 2018 from corresponding International Patent Application No. PCT/US2018/051262.

* cited by examiner

ADAPTIVE TRAFFIC CONTROL SYSTEM AND METHOD FOR OPERATING SAME

CROSS REFERENCE TO RELATED APPLICATION

The present application claims the benefit of U.S. provisional application 62/560,269, filed Sep. 19, 2017, entitled "Adaptive Traffic Control System and Method for Operating Same," the content of which is hereby incorporated by reference herein in its entirety.

FIELD OF INVENTION

The present invention generally relates to a traffic control system, and particularly to a system, software program and method for adaptively controlling a traffic light based upon traffic flow monitored at a number of traffic lights within a geographical area.

BACKGROUND

It is widely known that traffic congestion, particularly in large metropolitan areas, can cause excessive delays, an excessive amount of fuel consumption and an excessive generation of vehicle exhaust. Techniques exist in which vehicular drivers are notified of nearby traffic congestion, thereby allowing drivers an opportunity to individually attempt alternative routes so as to avoid adding onto the existing traffic congestion. However, such techniques do not address measures to reduce traffic congestion from occurring in the first instance.

SUMMARY

Example embodiments disclose a system, program code product and method of controlling traffic at a first intersection having a first traffic light, including monitoring traffic at the first intersection and storing traffic information from the monitoring in memory; receiving traffic information relating to one or more other intersections in an area in which the first intersection is located; determining a timing sequence for the first traffic light based at least in part upon the traffic information from the monitoring and the received traffic information; and updating control of the first traffic light to utilize the determined timing sequence In one aspect, the system, program code product and method include determining an amount of traffic at the first intersection during the monitoring, which includes identifying a first set of vehicles which turn left when passing through the first intersection from a first direction during a first period of time, identifying a second set of vehicles which turn right when passing through in the first intersection from the first direction during the first period of time, and identifying a third set of the vehicles which pass through the first intersection from the first direction without turning during the first period of time, wherein determining the timing sequence is based at least in part upon the first set of vehicles, the second set of vehicles and the third set of vehicles.

The system, program code product and method may further include updating the control of the first traffic light results in vehicles passing through the area having improved fuel efficiency, relative to vehicles passing through the area without control of the first traffic light being updated to utilize the determined timing sequence. Updating the control of the first traffic light results in vehicles passing through the area having reduced travel time through the area, relative to travel times of vehicles passing through the area without the first traffic light being updated to utilize the determined timing sequence.

In one aspect, the system, program code product and method include determining that an emergency vehicle is passing through the area towards a desired destination, wherein determining the timing sequence is based at least in part upon a path for the emergency vehicle passing through the area towards the desired destination.

The system, program code product and method may further include receiving a second timing sequence for each of one or more other traffic lights in the area, wherein determining the timing sequence is based upon the second timing sequence of each of the one or more other traffic lights.

The system, program code product and method may include maintaining a plurality of weighted goals for vehicles travelling through the area, wherein determining the timing sequence is partly based upon the weighted goals.

In one aspect, determining the timing sequence is based upon at least one of a current timing sequence used by the first traffic light and a timing sequence previously used thereby. In addition or in the alternative, determining the time sequence is based upon at least one of a current time of day and current day of the week.

In an aspect, the system, program code product and method may include following the updating, repeating the monitoring, the receiving, the determining and the updating. Repeating the monitoring, the receiving, the determining and the updating may occur on a continuous or periodic basis.

BRIEF DESCRIPTION OF THE DRAWINGS

Aspects of the invention will be explained in detail below with reference to exemplary embodiments in conjunction with the drawings, in which.

DETAILED DESCRIPTION

The following description of the example embodiments is merely exemplary in nature and is in no way intended to limit the invention, its application, or uses.

The example embodiments presented herein are generally directed to a system, software product and operating method for adaptively controlling traffic in a geographical area. Traffic is adaptively controlled by controlling the timing sequence of traffic lights in the area based upon current traffic information monitored at each traffic light and/or other locations in the geographical area. By adaptively controlling the timing of each traffic light based upon traffic monitored, the traffic passing through the geographical area may be improved or enhanced with respect to one or more goals or objectives, such as a reduction in travel time, an improvement in fuel economy and a reduction in vehicle created pollutants.

Figure 1:
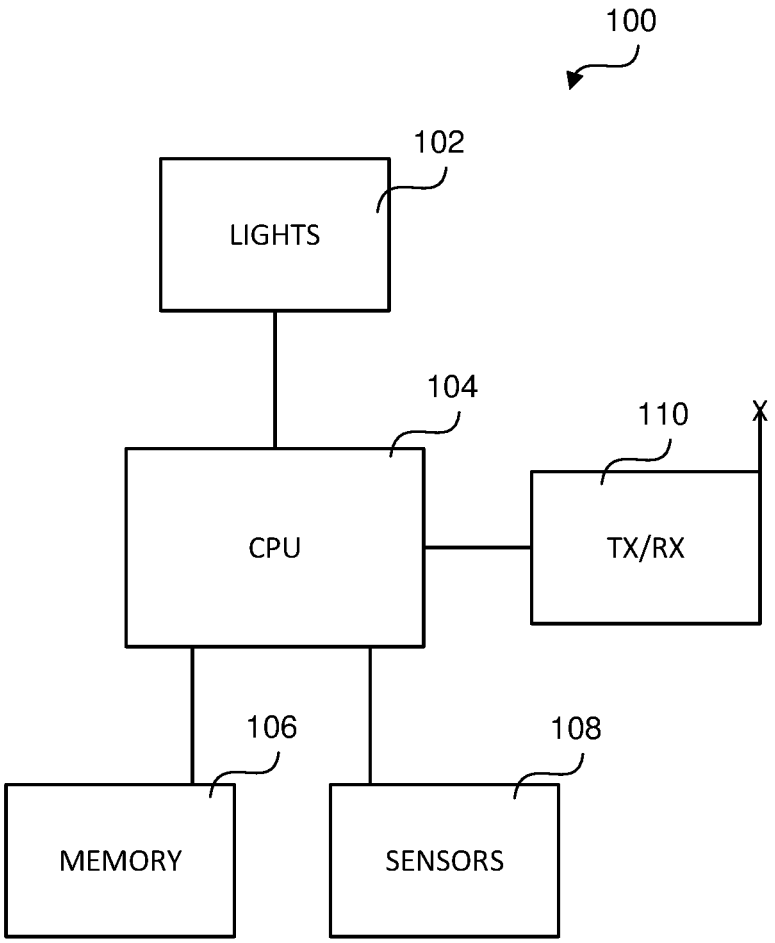
FIG. 1 is a block diagram of an intelligent traffic light according to an example embodiment.

FIG. 1 is a block diagram depicting a traffic light 100 according to an example embodiment. Traffic light 100 includes lights 102, the sequenced illumination of which provide instructions to drivers of vehicles entering an intersection, as is widely known. Each light 102 may be a single light or formed from a plurality of smaller lighting devices, such as light emitting diodes.

Lights 102 are coupled to and controlled by a central processing unit (CPU) 104. CPU 104 may be formed from one or more processors, processing elements and/or controllers. Memory 106 is coupled to CPU 104 and includes nonvolatile memory having stored therein program code which, when executed by CPU 104, results in, among other things, CPU 104 controlling the activation and deactivation of lights 102 in a certain timing sequence so as to control traffic passing through the intersection to which traffic light 100 is associated.

As shown in FIG. 1, a sensor arrangement 108 is coupled to CPU 104. In an example embodiment, sensor arrangement 108 includes sensors, cameras and/or other devices for sensing motor vehicles (e.g., automobiles, trucks, motorcycles, scooters, and mopeds) and non-motorized vehicles (e.g., bicycles) entering and leaving the intersection to which traffic light 100 is associated. The sensors may utilize any sensing technology or any combination of sensing technologies, including but not limited to optical (LIDAR), radio frequency (radar) and thermal sensing. The number of sensors, cameras, etc. in sensor arrangement 108 is sufficient to view traffic in any direction which vehicles traverse when entering or leaving the intersection. For example, if traffic light 100 controls the intersection of two streets that are orthogonal to each other, sensors in sensor arrangement 108 are capable of monitoring traffic in four directions (i.e., in both directions of each street). The output of sensors of sensor arrangement 108 is provided to CPU 104 which determines, among other things, traffic flow through the intersection which traffic light 100 controls, as described in greater detail below.

Traffic light 100 further includes transceiver 110 coupled to CPU 104 for communicating information over the air interface. Transceiver 110 includes a transmitter and a receiver. Transceiver 110 may utilize one or more of radio frequency, optical and thermal communication technologies. In an example embodiment, traffic light 100 may utilize the Dedicated Short Range Communication (DSRC) protocol in communicating over the air interface. It is understood, however, that traffic light 100 may utilize other known communication protocols, including code division multiple access (CDMA), global system for mobile (GSM), long-term evolution (LTE), wireless local area network (WLAN) and/or Wi-Fi, and/or protocols which have not yet been developed for communicating over the air interface.

Figure 2:
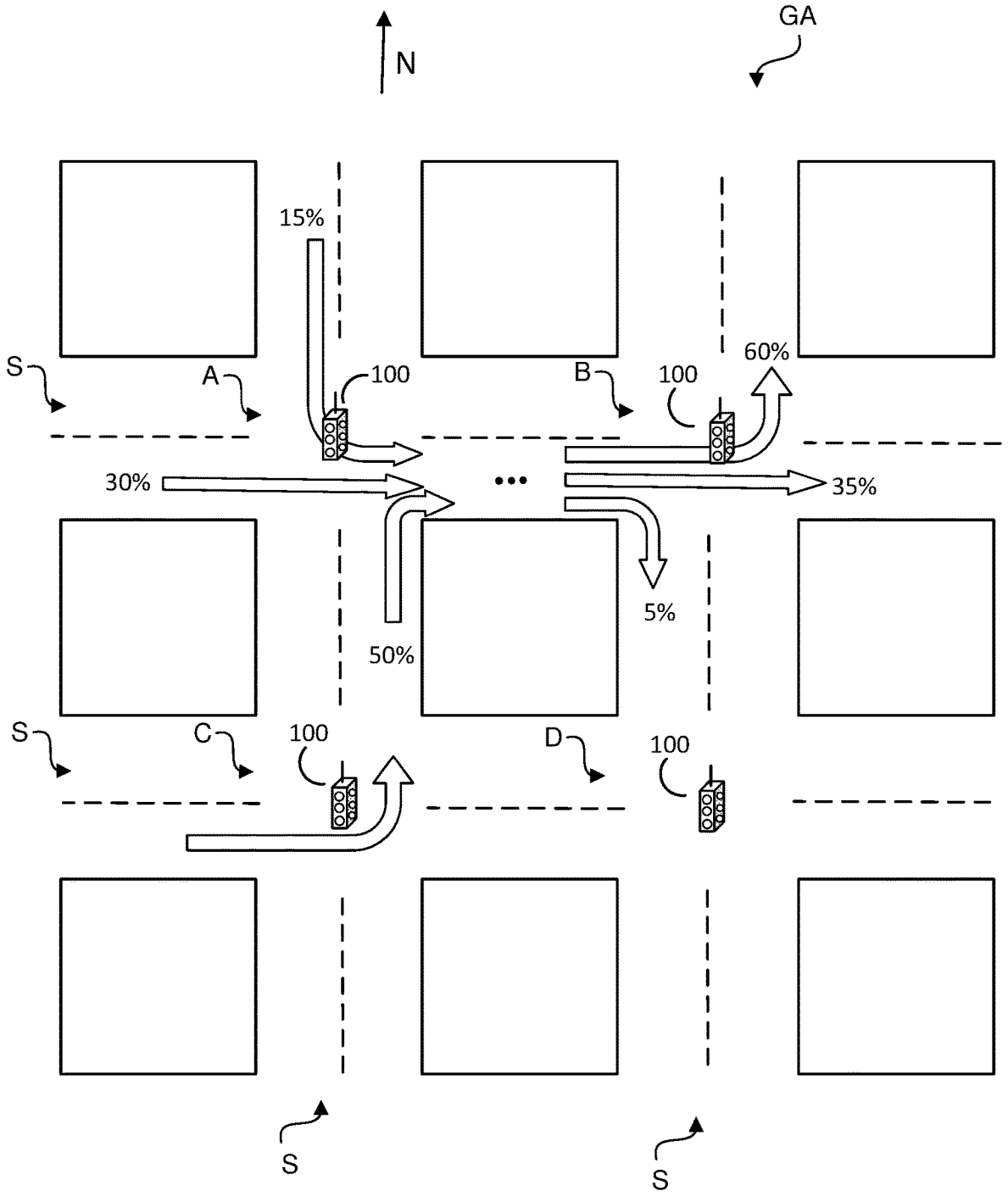
FIG. 2 is a top view of a city area having the traffic light of FIG. 1 at street intersections.

FIG. 2 illustrates a bird's eye view of a portion of a city covering geographical area GA and having a number of streets S therein. In this example embodiment, each intersection of two streets S includes one or more traffic lights 100 for controlling traffic through the intersection. Street intersections A-D are illustrated. For simplicity, each intersection A-D includes a single traffic light 100 but it is understood that multiple traffic lights 100 may be utilized in any one intersection A-D for adequately controlling the traffic flow therethrough. In the case of an intersection including multiple traffic lights 100 which combine to control traffic flow through a corresponding intersection, each traffic light 100 may be implemented as shown in FIG. 1. Alternatively, traffic lights 100 associated with the same intersection may share a common transceiver 110, CPU 104, memory 106 and/or sensor arrangement 108. Traffic lights 100 controlling a plurality of intersections A-D of streets S combine to form an adaptive traffic control system for controlling traffic in geographical area GA of FIG. 2.

In the adaptive traffic control system, each traffic light 100 monitors traffic through use of the sensors in sensor arrangement 108 and shares such monitored or sensed traffic information with other traffic lights 100 in the same geographical area GA. With the monitored traffic a traffic light 100 generates, and with the monitored traffic information shared by other traffic lights 100 in the geographical area GA, traffic light 100 determines the timing sequence for activating and deactivating lights 102 thereof.

Figure 3:
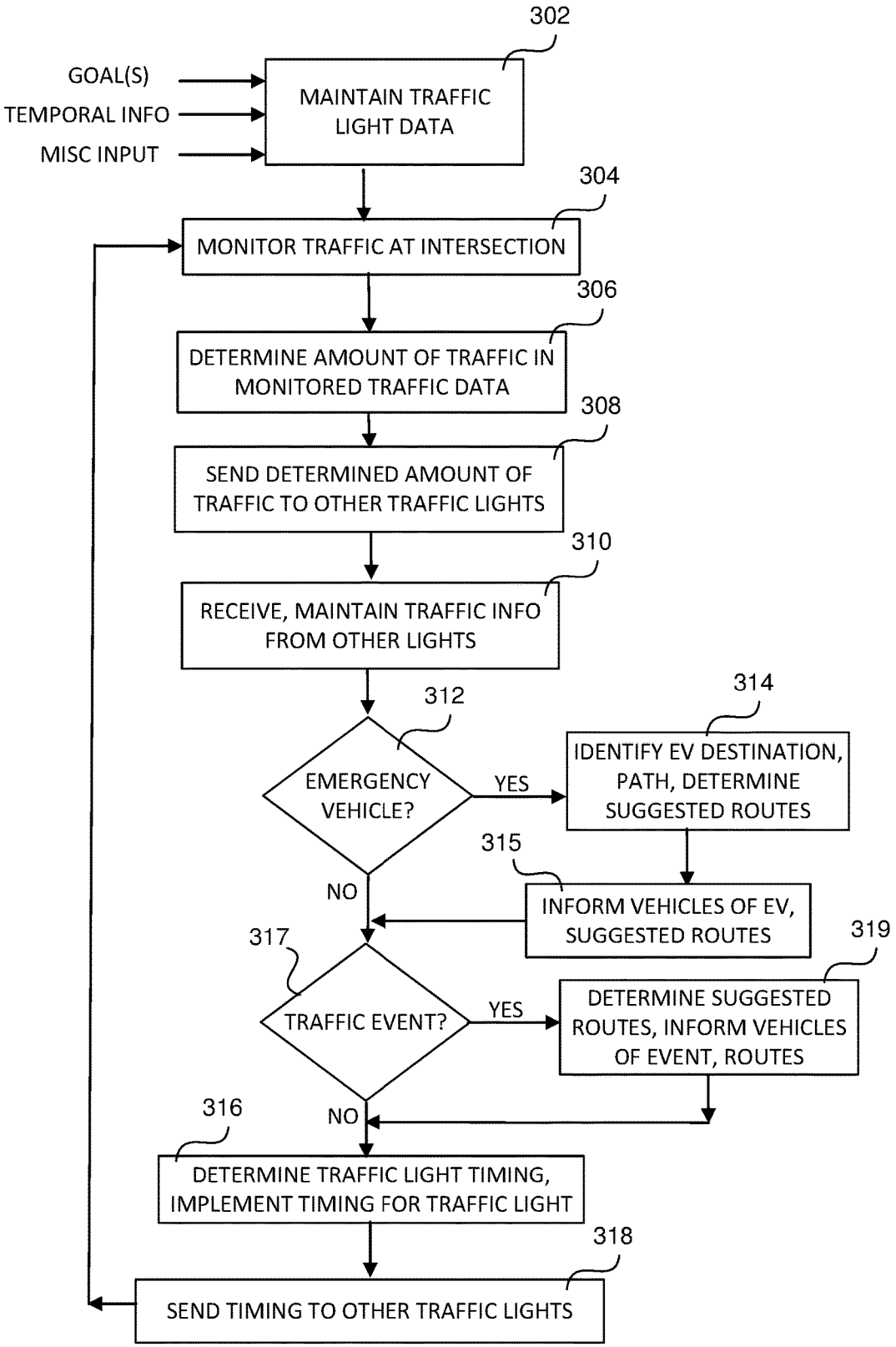
FIG. 3 is a flowchart illustrating an operation of the traffic light of FIG. 1, according to an example embodiment.

FIG. 3 illustrates the operation of a traffic light 100 according to one or more example embodiments. In describing the operation, it is understood that traffic light 100 is associated with an intersection A-D in geographical area GA illustrated in FIG. 2. The illustrated operation may be performed by any or all traffic lights in geographical area GA.

Initially, at 302 traffic light 100 maintains in memory 106 traffic light data associated with traffic lights 100 in geographical area GA. The traffic light data stored in memory 106 may include current and past timing sequences for activating and deactivating lights 102 of traffic light 100. The past timing sequences for activating/deactivating lights 102 may vary based upon the time of day, the day of the week and the month or season. The traffic light data stored in memory 106 of traffic light 100 may also include similar timing sequence information, current and past, for activating/deactivating other traffic lights 100 in geographical area GA. For clarity, it is understood that the timing sequences for activating and deactivating lights 102 of a traffic light 100 may include, for each light 102, the relative time when light 102 is to be activated (i.e., turned on), the amount of time light 102 is to remain activated, the relative time when light 102 is to be deactivated (i.e., turned off) and the amount of time light 102 is to remain deactivated. By "relative time" it is understood that the activation time and the deactivation time are relative to the activation and/or deactivation of one or more other lights 102 in traffic light 100.

In addition, traffic light 100 may receive additional information for use by CPU 104 and storage in memory 106. For example, CPU 102 may maintain the current time, day, month and year in memory 106.

The traffic information maintained in memory 106 may also include traffic goal information. In an example embodiment, the traffic goal information may be a list of goals or objectives for traffic lights 100 in geographical area GA. For instance, one goal may be for traffic lights 100 in geographical area GA to control traffic therein so as to result in shorter travel times for vehicles passing through geographical area GA. Another goal may be for traffic lights in geographical area GA to control traffic therein so as to improve or optimize fuel efficiency of vehicles passing through geographical area GA. In addition, the traffic information stored in memory 106 may include weighting information for assigning weights to each goal.

At 304, sensor arrangement 108 of traffic light 100 monitors traffic activity associated with the intersection with which traffic light 100 is associated, which is then stored in memory 106. This may be performed by including sensors of sensor arrangement 108 facing both directions along each street S forming the intersection. The monitored or sensed traffic activity may be saved in memory 106 as raw video data. In an example embodiment, traffic light 100 periodically monitors traffic activity associated with the corresponding intersection for a predetermined period of time. In another example embodiment, sensor arrangement 108 continuously monitors traffic activity and CPU 104 periodically saves the monitored traffic activity in memory 106. In addition, CPU 104 may save the monitored traffic activity in the same locations in memory 106 in which previously monitored traffic activity was saved. In this way, memory 106 only maintains the most recent period of time in which traffic activity was monitored by sensor arrangement 108.

Next, CPU 104 determines at 306 the amount of traffic passing through the corresponding intersection based upon the traffic activity monitored during step 304. CPU 104 determines the amount of traffic in part by identifying moving vehicles in the monitored traffic data generated in step 304. CPU 104 may also determine statistics relating to the determined amount of traffic passing through the corresponding intersection. For instance, for the traffic leaving a corresponding intersection in a first direction during a period of time, CPU 104 of a traffic light 100 may determine the percentage of such traffic having entered the intersection from each of the other directions. Specifically, for the traffic leaving a corresponding intersection in an eastward direction, CPU 104 determines the percentage of such traffic which entered the intersection from the north, from the west and from the south. In an example embodiment, the period of time during which traffic activity is monitored in step 304 is a full cycle of the traffic light 100, i.e., in which each light 102 of traffic light 100 is activated and deactivated, such that the determined amount of traffic passing through the corresponding intersection is the amount of traffic during a full cycle of traffic light 100.

With continued reference to FIG. 3, at 308 CPU 104 sends the determined amount of traffic to the other traffic lights 100 in geographical area GA. CPU 104 utilizes the transmitter in transceiver 110 for sending the determined amount of traffic. Traffic light 100 may broadcast the determined amount of traffic simultaneously to the other traffic lights 100 in geographical area GA. At 310, CPU 104 receives traffic information from the other traffic lights 100 in geographical area GA, and stores same in memory 106. The received traffic information may be, for example, a determined amount of traffic as discussed in step 306 but for the intersection corresponding to the traffic light 100 which sent the traffic information. Additionally or alternatively, the traffic information may be determinations made by other traffic lights 100 in the geographical area GA as to the timing sequence for activating and deactivating the corresponding traffic lights 102, as discussed in greater detail below. The traffic information received may be broadcasted by the traffic light 100 to all of the traffic lights in geographical area GA.

At 312, traffic light 100 determines whether there is any emergency vehicle in geographical area GA which is responding to an emergency situation. An emergency vehicle may be a law enforcement vehicle, an ambulance, a fire truck, etc. Traffic light 100 may determine whether such an emergency vehicle is in geographical area GA by receiving a broadcast signal from the emergency vehicle which identifies the vehicle as such and includes a request to quickly pass through geographical area GA. Alternatively, traffic light 100 may determine whether an emergency vehicle is in geographical area GA and is responding to an emergency by another traffic light 100 in geographical area GA transmitting, forwarding or otherwise sharing the contents of the broadcast signal which the other traffic light receives. It is understood that traffic light 100 may determine the presence of an emergency vehicle in geographical area GA and responding to an emergency through other means, such as by CPU 104 detecting such an emergency vehicle from sensed data from a sensor(s) in sensor arrangement 108.

Upon an affirmative determination that an emergency vehicle is in geographical area GA and is responding to an emergency, at 314 traffic light 100 identifies a destination for the emergency vehicle and/or a location from which the emergency vehicle will likely exit geographical area GA. The emergency vehicle's destination may, for example, be provided in the broadcast signal mentioned above which is transmitted by the emergency vehicle. With the destination of the emergency vehicle known, traffic light 100 may determine whether the path of the emergency vehicle to the destination passes or should pass through the intersection associated with traffic light 100. At 316, traffic light 100 determines the timing sequence for activating and deactivating lights 102 thereof, and controls lights 102 using the determined timing sequence. In this case in which an emergency vehicle is in geographical area GA and responding to an emergency, traffic light 100 determines the timing sequence with the highest priority of allowing the emergency vehicle to quickly pass through geographical area GA. Upon an affirmative determination by traffic light 100 in step 314 that the path emergency vehicle includes passing through the corresponding intersection, the timing sequence for lights 102 of traffic light 100 may be such so as to provide a green light to the emergency vehicle until a predetermined period of time after the emergency vehicle passes through the corresponding intersection. In the event the path of the emergency vehicle will not pass through the intersection corresponding to traffic light 100, traffic light 100 may determine the timing sequence for activating and deactivating lights 102 of traffic light 100 so as to provide less traffic in the direction of the path of the emergency vehicle.

Traffic light 100, as well as other traffic lights 100 in the geographical area GA, may inform vehicles at 315 within a communication range of the existence of the emergency vehicle. This communication may be performed using the transceiver 110 of traffic light 100 via infrastructure-to-vehicle communication. The information transmitted by transceiver 110 may include, for example, the path the emergency vehicle is travelling or should travel through geographical area GA, and suggested alternate routes to take to avoid the emergency vehicle and traffic congestion caused thereby. In one embodiment, traffic light 100 communicates the information to vehicles by broadcasting the information to all vehicles within the communication range of traffic light 100. In another embodiment, traffic light 100 communicates the information to each vehicle in a separate communication solely to that vehicle. The use of transmitting the information via individual communications allows for the suggested alternate route(s) to be specific to a vehicle, i.e., the alternate route(s) for a particular vehicle may be determined by traffic light 100 based upon the location and route of the vehicle relative to the emergency vehicle. With vehicles being sent individual communications, in an embodiment only the vehicles within the communication range which are impacted by the emergency vehicle may be informed of the emergency vehicle. For instance, vehicles which are within the communication range of traffic light 100 but are travelling away from the emergency vehicle and the path thereof may be identified by traffic light 100 as not to receive information of the emergency vehicle. Other vehicles which are already travelling along a suggested alternate route which avoids the emergency vehicle and potential traffic caused thereby may be identified by traffic light 100 and also not informed of the emergency vehicle.

Traffic light 100 may determine, from the monitored traffic data and the traffic information received from other traffic lights, whether there is traffic congestion or a traffic congestion causing event at 317. Such an event may, for example, be a stationary object causing unanticipated traffic congestion, such as a disabled vehicle, a vehicle accident, road construction blocking part or all of one or more streets S, and a road closure. In response to the determination of traffic congestion from a traffic event, traffic light 100 at 319 determines suggested alternate routes for vehicles in the streets surrounding the traffic congestion, and communicates the existence of the traffic congestion/traffic event and such alternate routes to the vehicles within the communication range of traffic light 100. This communication may be a broadcast transmission by traffic light 100 to all vehicles within the communication range thereof. In another embodiment, traffic light 100 communicates the information to vehicles via individual communications. By transmitting the information to vehicles via individual communications, the particular suggested alternate route or routes communicated to a particular vehicle may be determined by traffic light 100 based upon the location and route of the vehicle relative to the location of the traffic congestion or event causing same, such that vehicles receiving the information from traffic light 100 may receive different suggested routes. It is also contemplated that in one embodiment, only the vehicles within the communication range which are impacted by the traffic congestion of the traffic event may be informed of the congestion and provided alternate routes. In this way, vehicles that are already travelling along a suggested alternate route will not be contacted.

It is understood that acts 312-315 concerning a moving emergency vehicle and the acts 317-319 concerning a stationary traffic congestion causing event may utilize the same or similar algorithms and/or algorithmic steps for determining suggested alternate routes and identifying those vehicles within the communication range which are to be contacted.

In the more common scenario in which no emergency vehicles are responding to an emergency in geographical area GA, traffic light 100 determines at 316 the timing sequence for lights 102 without consideration for accommodating an emergency vehicle. In an example embodiment, traffic light 100 determines the timing sequence for lights 102 based upon the amount of traffic determined in step 306 and the traffic information received by other traffic lights 100 in step 310. Traffic light 100 may also determine the timing sequence for lights 102 based upon the goals received in step 302 and/or the current time of day, day of week and/or month/season. Traffic 100 may also determine the timing sequence for lights 102 based upon previously determined timing sequences therefor.

In an example embodiment, traffic light 100 possesses artificial intelligence, self-learning and/or self-adapting capabilities. CPU 104 may use artificial intelligence, self-learning and/or self adapting algorithms or techniques for determining the amount of traffic in step 306 and determining the timing sequence for lights 102 in step 316. In this regard, symbolic rules and/or neural networks may be utilized for making such determinations.

Following the determination by traffic light 102 of the timing sequence for lights 102 at 316, traffic light 100 sends the determined timing sequence to other traffic lights 100 in the geographical area GA at 318. The transmission of the timing sequence may be via transmission of a broadcast signal using the receiver of transceiver 110. The transmission of the timing sequence to other traffic lights 100 allows each such other traffic light 100 to determine the timing sequence for its own lights 102. By sharing the determined timing information with each other, traffic lights 100 in the geographical area GA are able to better and more efficiently control traffic in geographical area GA. Optionally, the determined timing sequences may be altered manually or otherwise following their generation, before the sequence is transmitted to other traffic lights.

The flowchart of FIG. 3, as discussed above, will be applied to the traffic scenario in FIG. 2. FIG. 2 shows four two-street intersections A-D in geographical area GA. Each intersection A-D includes a traffic light 100. At intersection B, traffic light 100 monitors, among other traffic, traffic approaching intersection B from the west (i.e., from intersection A) at step 304 and determines at 306 that 60% of such approaching traffic turns left (north) at intersection B, 35% of such approaching traffic does not turn at intersection B and continues in an eastward direction, and 5% of the approaching traffic turns right (south) at intersection B. Further, traffic light 100 at intersection B also learns, from receiving traffic information from the traffic light 100 at intersection A at step 310, that of the traffic leaving intersection A and heading east towards intersection B, 15% enters intersection A from the north, 30% enters intersection A from the west and 50% enters intersection A from the south, with 5% entering from the east and utilizing a U-turn. Traffic light 100 at intersection B may determine at 316 the timing sequence for lights 102 of traffic light 100 based upon the amount of traffic determined at step 306 and the traffic information received at step 310. In the traffic scenario of FIG. 2, and to lessen traffic at intersection B, the timing sequence determined by traffic light 100 of intersection B may call for an increase in duration for traffic entering intersection B from the east and turning left—in other words, increasing the time for eastbound vehicles to turn left (north) at intersection B.

Traffic light 100 at intersection C also follows the flowchart of FIG. 3. Traffic light 100 monitors traffic at intersection C, and determines an amount of traffic at intersection C at step 306. Traffic light 100 at intersection C also sends its determined amount of traffic to other traffic lights 100 at 308, and receives the amount of traffic determined by other traffic lights 100 in geographical area GA, such as traffic lights 100 of intersections A, B and D. Traffic light 100 at intersection C determines the timing sequence for lights 102 thereof at step 316, and shares such timing sequence with other traffic lights in geographical area GA at 318. With respect to the traffic scenario of FIG. 2, at least to partly lessen the amount of traffic at intersection B, the timing sequence determined by traffic light 100 at intersection C may result in a decrease in duration for eastbound traffic at intersection C turning left (i.e., north). In this way, a traffic light 100 at one intersection (intersection C, in this case) may adaptively change the timing sequence of its lights 102 so as to have a direct effect on the traffic at another intersection (intersection B).

Traffic lights 100 within geographical area GA may change and/or update the timing sequences for lights 102 thereof on a regular basis. In an example embodiment, traffic light 100 continually updates its timing sequence so that traffic lights 100 in geographical area GA are controlled in real time or near real time to traffic scenarios and thus provides enhanced traffic control. For example, traffic lights 100, through sharing traffic information with each other, may timely and fully respond to any of a number of traffic congestion causing events in geographical area GA, such as a disabled vehicle, vehicular accident, road construction blocking at least part of a street S, or a road closure, by routing traffic through other streets S, as explained above.

Figure 4:
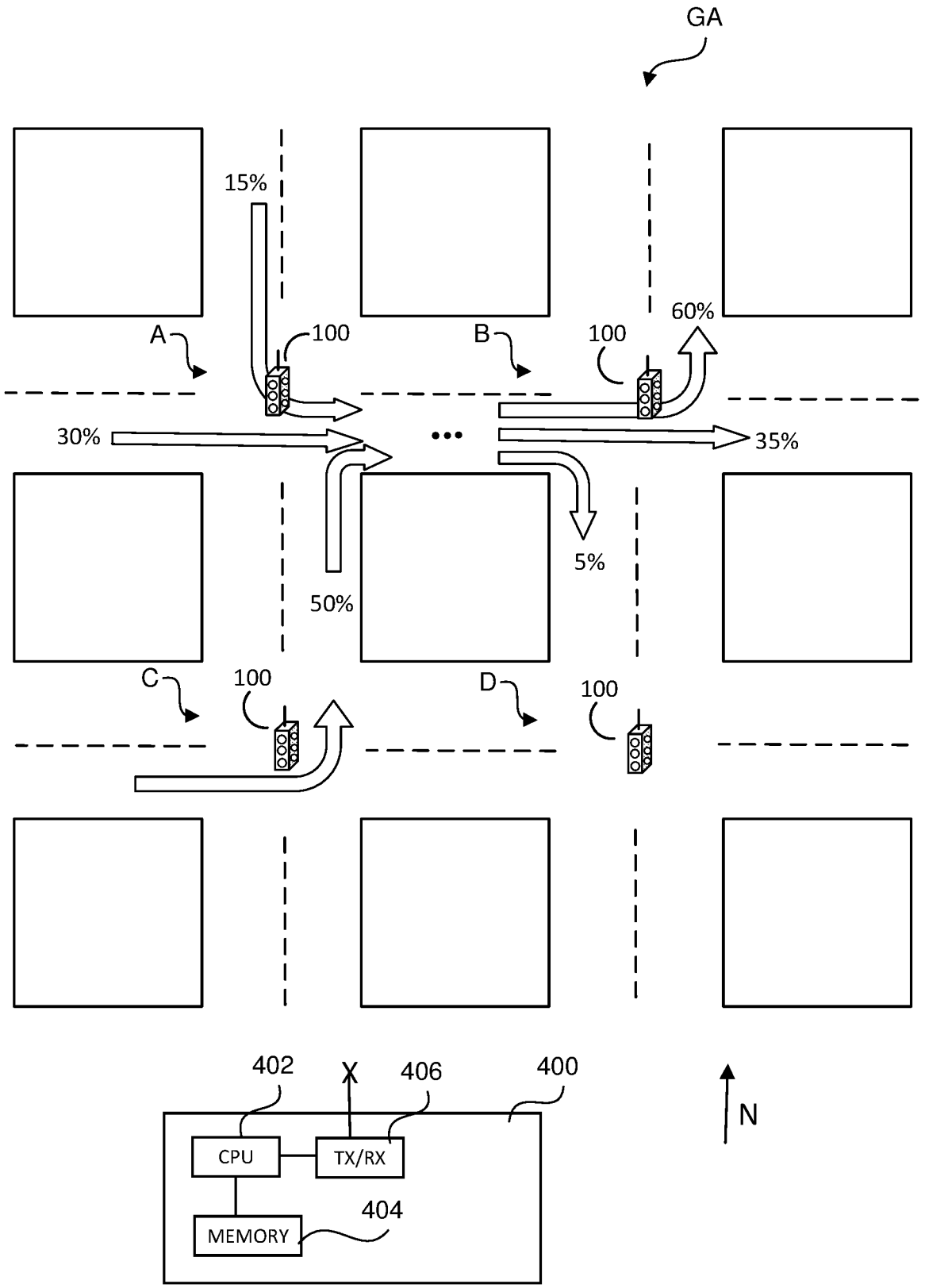
FIG. 4 is a top view of a city area having traffic lights of FIG. 1 and a central computing device, according to another example embodiment.

Traffic lights 100 have been described above as being configured to determine an appropriate timing sequence for lights 102 thereof. In an alternative embodiment, determining the appropriate timing sequence for lights 102 of traffic lights 100 may be performed not by traffic lights 100 themselves but instead at a central and/or remote location. Referring to FIG. 4, a central computing device 400 is communicatively coupled to traffic lights 100 within geographical area GA. Computing device 400 includes a CPU 402 and memory 404 coupled thereto. Memory 404 may include nonvolatile memory and have stored therein program code for, among other things, communicating with traffic lights 100 as well as determining an amount of traffic and the timing sequence for each traffic light 100 in geographical area GA. Computing device 400 further includes transceiver 406 coupled to CPU 402 having at least a transmitter and a receiver for communicating with traffic lights 100 over the air interface. Traffic lights 100 and computing device 400 may utilize any one or more of a number of wireless communication techniques, protocols and/or approaches, including Wi-Fi, DSRC, WLAN, CDMA, GSM and LTE. In another embodiment, computing device 400 and traffic lights 100 are hardwired together and communicate over the hardwired connection.

The operation of computing device 400 will now be described with reference to FIG. 5. Computing device 400 maintains traffic light data in memory 404 for every traffic light 100 with which computing device 400 is associated. In the example embodiment, memory 404 maintains traffic light data for every traffic light 100 in geographical area GA. The traffic light data may include the same or similar traffic light data which is maintained in memory 106 of each traffic light 100 described above. In particular, the traffic light data may include past and current timing sequence for activating and deactivating lights 102 of each traffic light 100. The past timing information for activating/deactivating lights 102 of traffic lights 100 may vary and be based upon the time of day, the day of the week and the month and/or season.

The traffic information maintained in memory 404 may include traffic goal information for traffic lights 100 within geographical area GA, as described above.

Computing device 400 may receive traffic information from traffic lights 100 at 504. The traffic information may be traffic monitored by each traffic light 100 at 304 in FIG. 3, and/or the amount of traffic determined by each traffic light at 306 above. If only the monitored traffic is provided by traffic lights 100, computing device 400 determines the amount of traffic, similar to the determination performed by traffic light 100 at 306 above. Computing device 400 determines at 506 whether an emergency vehicle is in geographic area GA and upon an affirmative determination, identifies the destination and/or path through geographic area GA at 508, determines the timing sequence for each traffic light 100 at 510 based upon the destination and/or path, and transmits such determined timing sequences to the corresponding traffic lights at 512, similar to the actions taken by traffic lights 100 as described above with respect to FIG. 3. In addition, computing device 400 at 509 may inform vehicles in geographical area GA of the emergency vehicle and the path the emergency vehicle is taking or should take in geographical area GA, and determine and provide suggested alternate routes to the vehicles in order to better avoid traffic caused by the emergency vehicle, the same as or similar to the actions taken by traffic lights 100 as explained above with respect to steps 314 and 315 of FIG. 3. Further, computing device 400 may also determine at 511 whether there exists traffic congestion and/or an event causing traffic congestion, such as a disabled vehicle, vehicle accident, or road construction. Upon an affirmative determination, at 513 computing device 400 may identify vehicles in geographical area GA that are impacted by the traffic congestion, determine suggested alternate routes for the impacted vehicles, and communicate to each impacted vehicle the existence of the traffic congestion/traffic congestion causing event and the suggested alternate routes for the vehicle. Steps 511 and 513 performed by computing device 400 may be similar to the steps 317 and 319 in FIG. 3 performed by traffic light 100.

In the event no emergency vehicles in the geographical area GA are responding to an emergency situation, computing device 400 determines the timing sequence for each traffic light 100 in geographical area GA at 510, and transmits the timing sequence to each corresponding traffic light at 512, similar to steps taken by a traffic light 100 (in steps 316 and 318, respectively) in FIG. 3. The timing sequence for each traffic light 100 may be based upon the determined amount of traffic monitored by each traffic light 100, current or past timing sequences, the current time of day, day of week, month and/or season, goals provided to computing device 400, other manual input, etc.

In determining the amount of traffic at each intersection A-D and the timing sequence for each traffic light 100, CPU 104 utilizes artificial intelligence, self-learning and/or self-adapting capabilities and functionality.

One benefit of computing device 400 determining the amount of traffic and/or the timing sequence for each traffic light 100 instead of traffic lights 100 performing the same is that the computational power is centralized so that the cost of each traffic light 100 is reduced relative to a traffic light 100 having the structure and functionality as described above with respect to FIGS. 1 and 3.

In the example embodiments discussed above, traffic lights 100 monitor traffic at intersections via the use of sensor arrangement 108. In another example embodiment, a sensor arrangement 108 may be deployed along streets and/or street intersections in geographical area GA to which no traffic light 100 is associated. For example, a sensing device 600 (FIG. 6) may include much of the components of traffic light 100 of FIG. 1, including a CPU 104, memory 106, sensor arrangement 108 and transceiver 110. However, sensing device 600 does not include lights 102 or the program code in memory 106 for determining the timing sequence therefor. Instead, CPU 104 of sensing device 600, by executing program code stored in memory 106, simply controls the monitoring of traffic at the corresponding intersection, optionally determining the amount of traffic based upon the monitored traffic, and transmitting the monitored traffic and/or the determined amount of traffic either to traffic lights 100 in the embodiment of FIGS. 2 and 3, or to computing device 400 in the embodiment of FIGS. 4 and 5. Each traffic light 100 or the computing device 400 then determines the timing sequence for traffic light 100 based at least upon the traffic monitored by sensing device 600.

Figure 5:
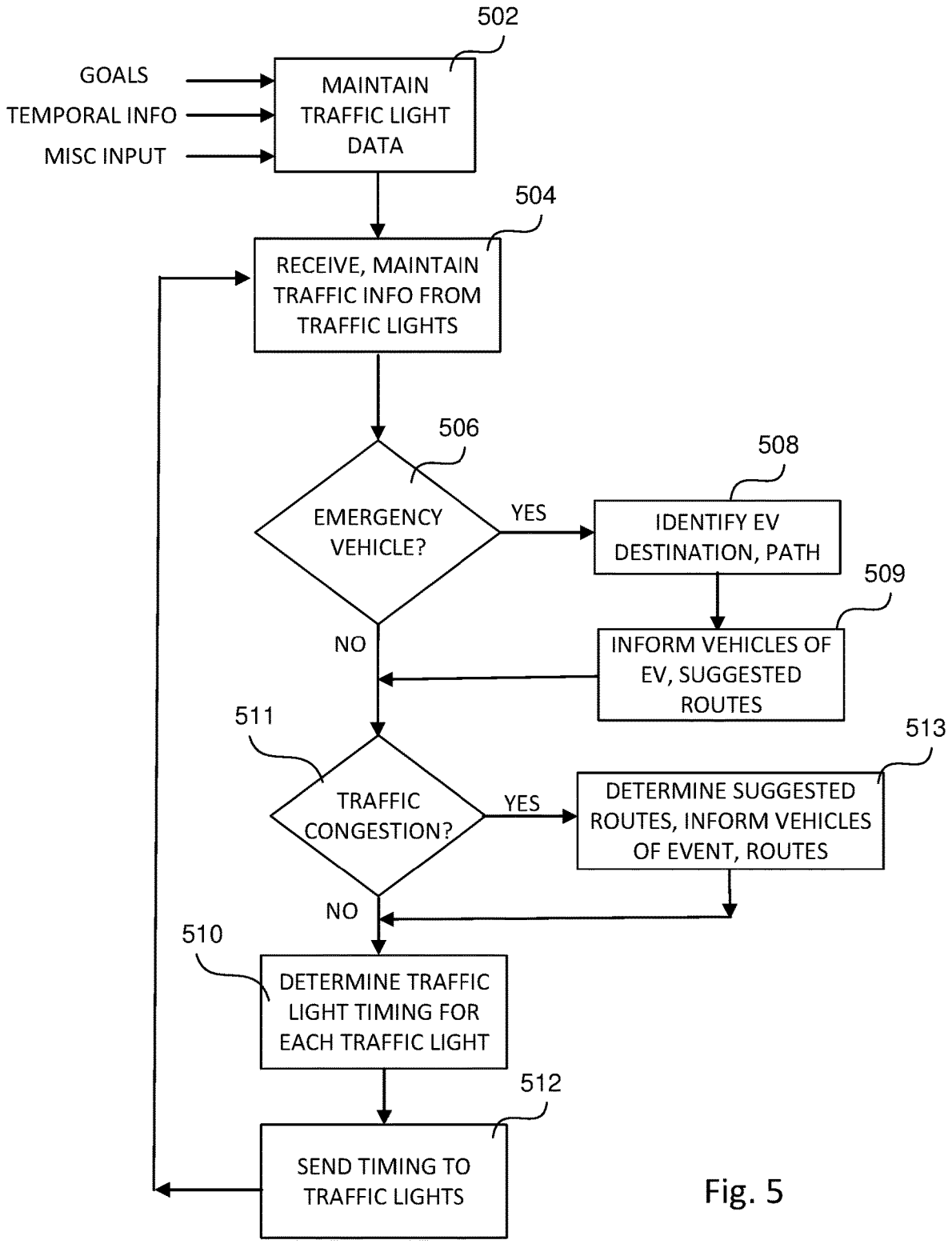
FIG. 5 is a flowchart illustrating an operation of the computing device of FIG. 4, according to an example embodiment.
Figure 6:
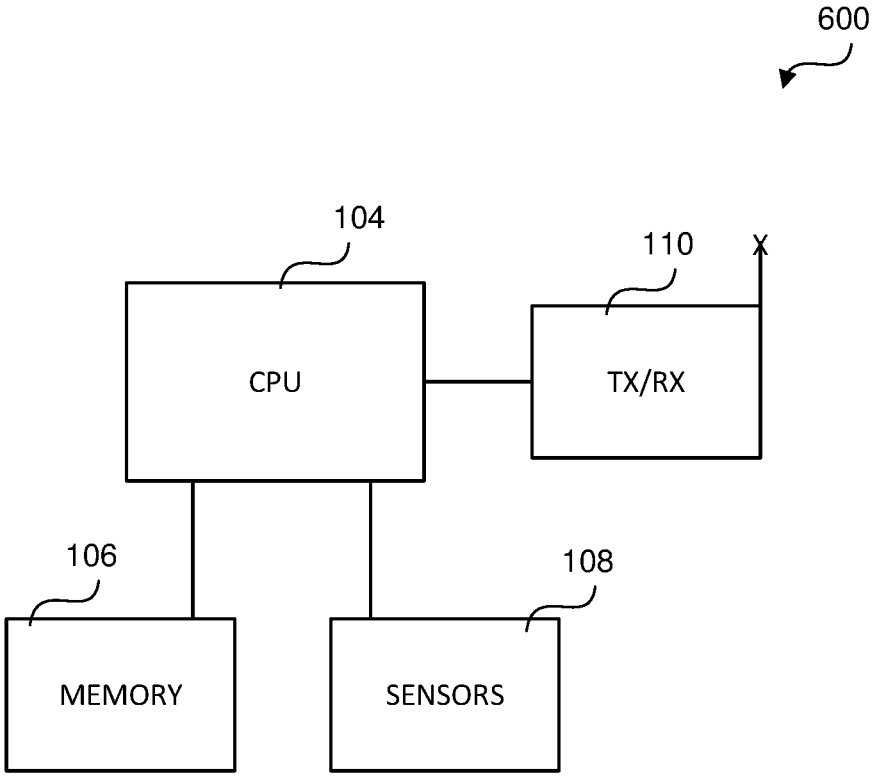
FIG. 6 is a block diagram of a traffic control device according to another example embodiment.

It is understood that the steps illustrated in FIGS. 3 and 5 may be performed in a different order than the order illustrated and described above.

The example embodiments have been described herein in an illustrative manner, and it is to be understood that the terminology which has been used is intended to be in the nature of words of description rather than of limitation. Obviously, many modifications and variations of the invention are possible in light of the above teachings. The description above is merely exemplary in nature and, thus, variations may be made thereto without departing from the spirit and scope of the invention as defined in the appended claims.

What is claimed is:

1. A method of controlling traffic at a first intersection having a first traffic light, comprising:

monitoring traffic at the first intersection and storing traffic information from the monitoring in memory;

receiving traffic information relating to one or more other intersections in an area in which the first intersection is located;

setting a plurality of weighted goals for vehicles travelling through the area, wherein the plurality of weighted goals includes to provide shorter travel times through the area, optimize fuel efficiency of vehicles passing through the area and reduction in vehicle created pollutants;

assigning weights to each of the plurality of goals to define a plurality of weighted goals;

determining a timing sequence for the first traffic light based at least in part upon the traffic information from the monitoring and the received traffic information, wherein receiving traffic information relating to one or more other intersections comprises receiving a second timing sequence for each of one or more other traffic lights in the area and determining the timing sequence is based upon the second timing sequence of each of the one or more other traffic lights and at least partly based on the weighted goals; and updating control of the first traffic light to utilize the determined timing sequence.

2. The method of claim 1, further comprising communicating the timing sequence with other traffic lights in the area.

3. The method of claim 1, further comprising determining an amount of traffic at the first intersection during the monitoring, comprises identifying a first set of vehicles which turn left when passing through the first intersection from a first direction during a first period of time, identifying a second set of vehicles which turn right when passing through in the first intersection from the first direction during the first period of time, and identifying a third set of the vehicles which pass through the first intersection from the first direction without turning during the first period of time, wherein determining the timing sequence is based at least in part upon the first set of vehicles, the second set of vehicles and the third set of vehicles.

4. The method of claim 1, further comprising determining that an emergency vehicle is passing through the area towards a desired destination, wherein determining the timing sequence is based at least in part upon a path for the emergency vehicle passing through the area towards the desired destination.

5. The method of claim 4, further comprising informing vehicles in the area of the emergency vehicle and the path thereof.

6. The method of claim 1, wherein determining the timing sequence is based upon at least one of a current timing sequence used by the first traffic light and a timing sequence previously used thereby.

7. The method of claim 1, wherein determining the timing sequence is based upon at least one of a current time of day and current day of the week.

8. The method of claim 1, wherein the monitoring, the receiving, the determining and the updating are performed by a processor of, at, or near the first traffic light.

9. The method of claim 1, further comprising determining, based upon at least one of the traffic information from the monitoring and the received traffic information, whether traffic congestion exists in the area, and upon a positive determination, determining one or more alternate routes for increasing avoidance of the traffic congestion, and informing vehicles in the area of the traffic congestion and the one or more alternate routes.

10. A program code product for controlling traffic, the program code product stored in non-transitory memory and including instructions which, when executed by a processor, causes the processor to:

monitor traffic at a first intersection in a predetermined geographical area and storing traffic information from the monitoring in memory;

receive traffic information relating to one or more other intersections in the predetermined geographical area in which the first intersection is located;

set a plurality of weighted goals for vehicles travelling through the area, wherein the plurality of weighted goals includes to provide shorter travel times through the area, optimize fuel efficiency of vehicles passing through the area and reduction in vehicle created pollutants;

assign weights to each of the plurality of goals to define a plurality of weighted goals;

determine a timing sequence for the first traffic light based at least in part upon the traffic information from the monitoring and the received traffic information, wherein the processor code includes instructions for the processor to receive a second timing sequence for each of one or more other traffic lights in the area and determine the timing sequence based upon the second timing sequence of each of the one or more other traffic lights and at least partly based on the weighted goals; and update control of the first traffic light to utilize the determined timing sequence.

11. The program code product of claim 10, wherein the instructions include instructions which, when executed by the processor, cause the processor to communicate the timing sequence with other traffic lights in the predetermined geographical area.

12. The program code product of claim 10, wherein the instructions include instructions for determining an amount of traffic at the first intersection during the monitoring, comprising instructions for identifying a first set of vehicles which turn left when passing through the first intersection from a first direction during a first period of time, identifying a second set of vehicles which turn right when passing through in the first intersection from the first direction during the first period of time, and identifying a third set of the vehicles which pass through the first intersection from the first direction without turning during the first period of time, wherein the instructions determine the timing sequence based at least in part upon the first set of vehicles, the second set of vehicles and the third set of vehicles.

13. The program code product of claim 10, wherein the instructions include instructions for determining that an emergency vehicle is passing through the predetermined geographical area towards a desired destination, wherein the instructions determine the timing sequence based at least in part upon a path for the emergency vehicle in the predetermined geographical area towards the desired destination.

14. The program code product of claim 13, wherein the instructions include instructions for informing vehicles in the predetermined geographical area of the emergency vehicle and the path thereof.

15. The program code product of claim 13, wherein the instructions include instructions for identifying, based upon at least one of the traffic information from the monitoring and the received traffic information, traffic congestion in the predetermined geographical area, determining one or more alternate routes for increasing avoidance of the traffic congestion, and communicating the alternative routes to vehicles in the predetermined geographical area.

16. The program code product of claim 10, wherein the instructions determine the timing sequence for the first traffic light based upon at least one of a current timing sequence used to control the first traffic light and a timing sequence previously used to control the first traffic light, the program code product utilizing a self-learning algorithm to determine the timing sequence for the first traffic light.

* * * * *